US010358245B2

(12) United States Patent
Riemenschneider, III et al.

(10) Patent No.: US 10,358,245 B2
(45) Date of Patent: Jul. 23, 2019

(54) SYSTEM AND METHOD OF APPLYING STRETCH FILM TO A LOAD

(71) Applicant: Paul Kurt Riemenschneider, III, Wyoming, MI (US)

(72) Inventors: Paul Kurt Riemenschneider, III, Grandville, MI (US); Robert Edward Kwock-Fai Ching, Elsie, MI (US); Lucas James Venechuk, Grand Rapids, MI (US)

(73) Assignee: Paul Kurt Riemenschneider, III, Wyoming, MI (US)

( * ) Notice: Subject to any disclaimer, the term of this patent is extended or adjusted under 35 U.S.C. 154(b) by 1 day.

(21) Appl. No.: 15/274,162

(22) Filed: Sep. 23, 2016

(65) Prior Publication Data

US 2017/0088301 A1 Mar. 30, 2017

Related U.S. Application Data

(60) Provisional application No. 62/233,116, filed on Sep. 25, 2015, provisional application No. 62/233,119, filed on Sep. 25, 2015, provisional application No. 62/233,123, filed on Sep. 25, 2015, provisional application No. 62/233,125, filed on Sep. 25, 2015.

(51) Int. Cl.

| | |
|---|---|
| ***B65B 57/04*** | (2006.01) |
| ***B65B 11/04*** | (2006.01) |
| ***B65B 41/16*** | (2006.01) |
| ***B65B 59/00*** | (2006.01) |

(52) U.S. Cl.
CPC ..... *B65B 57/04* (2013.01); *B65B 11/045* (2013.01); *B65B 41/16* (2013.01); *B65B 59/00* (2013.01); *B65B 2210/04* (2013.01)

(58) Field of Classification Search
CPC ..... B65B 57/04
See application file for complete search history.

(56) References Cited

U.S. PATENT DOCUMENTS

| | | | | | |
|---|---|---|---|---|---|
| 2,013,595 | A | | 9/1935 | Barnard | |
| 4,095,448 | A | | 6/1978 | Gipperich | |
| 4,300,326 | A | * | 11/1981 | Stackhouse | B65B 11/045 53/211 |
| 4,302,920 | A | * | 12/1981 | Lancaster | B65B 11/045 264/288.4 |
| 4,317,322 | A | * | 3/1982 | Lancaster | B65B 11/008 53/399 |

(Continued)

FOREIGN PATENT DOCUMENTS

| | | | | |
|---|---|---|---|---|
| DE | 2430269 | A1 | 2/1975 | |
| GB | 2348633 | A | 11/2000 | |
| WO | WO 2008129432 | A1 * | 10/2008 | B65B 11/004 |

*Primary Examiner* — Alexander M Valvis
*Assistant Examiner* — Lucas E. A. Palmer
(74) *Attorney, Agent, or Firm* — McGarry Bair PC

(57) ABSTRACT

A method of wrapping a load with a stretch wrapping system utilizes a system for monitoring film properties, a module in the stretch wrapping systems controller to analyze the data or film properties and further utilize the data to determine, at least in part, appropriate machine settings and or wrapping pattern for the film and execute by providing appropriate machine settings such that effective wrapping of the load and proper use of the film are achieved. The film properties include film stiffness.

17 Claims, 8 Drawing Sheets

(56) References Cited

U.S. PATENT DOCUMENTS 4,418,510 A * 12/1983 Lancaster, III ..... B65B 11/04 53/399
4,458,467 A * 7/1984 Shulman ..... B65B 11/045 242/418.1
4,503,658 A * 3/1985 Mouser ..... B65B 11/045 53/399
4,514,955 A * 5/1985 Mouser ..... B65B 11/045 53/211
4,573,305 A * 3/1986 Wildmoser ..... B65B 9/026 53/229
4,590,746 A * 5/1986 Humphrey ..... B65B 11/045 242/420.6
4,592,938 A 6/1986 Benoit
4,628,668 A * 12/1986 Wildmoser ..... B65B 9/026 53/399
4,676,048 A * 6/1987 Lancaster ..... B65B 11/008 53/210
4,693,049 A * 9/1987 Humphrey ..... B65B 11/045 53/556
4,706,443 A * 11/1987 Humphrey ..... B65B 11/045 53/556
4,712,686 A * 12/1987 Lancaster ..... A01F 15/071 206/597
4,718,219 A * 1/1988 Schmitz ..... B65B 11/045 53/211
4,840,006 A * 6/1989 Humphrey ..... B65B 11/045 53/556
4,850,177 A * 7/1989 Kaczkowski ..... B65B 13/12 53/556
4,862,678 A * 9/1989 Humphrey ..... B65B 11/045 53/556
4,936,073 A * 6/1990 Laczkowski ..... B65B 13/12 100/33 PB
5,235,792 A * 8/1993 Hanagata ..... B65B 61/00 53/141
5,606,849 A * 3/1997 Bettenhausen ..... B65B 11/045 53/210
5,636,496 A 6/1997 Pietilae et al.
5,765,344 A * 6/1998 Mandeville ..... B65B 11/025 53/389.3
5,934,473 A * 8/1999 Belshe ..... B65B 61/20 206/320
5,976,682 A 11/1999 Eichbauer
6,032,436 A 3/2000 Hart et al.
6,132,827 A 10/2000 Miro
6,151,863 A 11/2000 Lancaster, III et al.
6,195,961 B1 3/2001 Turfan
6,305,145 B2 * 10/2001 Suolahti ..... B65B 11/04 242/420.6
6,314,333 B1 * 11/2001 Rajala ..... B65H 23/048 226/44
6,370,839 B1 * 4/2002 Nakagawa ..... B65B 11/008 52/211
6,942,909 B2 9/2005 Shirrell et al.
7,908,830 B2 * 3/2011 Cousins ..... B65B 11/045 53/203
8,080,304 B2 12/2011 Clarke
8,453,420 B2 6/2013 Schmidt et al.
9,493,262 B2 * 11/2016 Lancaster, III ..... B65B 11/025
9,676,507 B2 * 6/2017 Kudia ..... B65B 65/003
9,776,748 B2 * 10/2017 Lancaster, III ..... B65B 11/008
9,891,120 B2 * 2/2018 Cere ..... B65B 11/045
2001/0015057 A1 * 8/2001 Suolahti ..... B65B 11/025 53/556
2002/0062631 A1 * 5/2002 Huson ..... B65B 11/025 53/588
2002/0174628 A1 * 11/2002 Lancaster, III ..... B65B 11/025 53/441
2002/0189210 A1 12/2002 Wiley
2004/0045259 A1 * 3/2004 Solis ..... B65B 11/045 53/399
2004/0163364 A1 * 8/2004 Cousins ..... B65B 11/045 53/556
2005/0123721 A1 6/2005 Heikaus et al.
2009/0178374 A1 * 7/2009 Lancaster, III ..... B65B 11/025 53/441
2009/0288372 A1 * 11/2009 Cere ..... B65B 11/025 53/461
2012/0102886 A1 * 5/2012 Lancaster, III ..... B65B 11/008 53/461
2013/0074454 A1 * 3/2013 Babrowicz ..... B32B 7/02 53/467
2013/0076753 A1 * 3/2013 Lancaster, III ..... B65B 57/00 345/440
2014/0223864 A1 * 8/2014 Lancaster, III ..... B65B 11/008 53/436
2017/0052075 A1 * 2/2017 Cere ..... B65B 11/045

* cited by examiner

SYSTEM AND METHOD OF APPLYING STRETCH FILM TO A LOAD

CROSS REFERENCE TO RELATED APPLICATIONS

This application claims the benefit of U.S. application No. 62/233,116 filed Sep. 25, 2015, U.S. application No. 62/233,119 filed Sep. 25, 2015, and U.S. application No. 62/233,123 filed Sep. 25, 2015, and U.S. application No. 62/233,125 filed Sep. 25, 2015, each of which is incorporated herein in its entirety.

BACKGROUND OF THE INVENTION

Unitized packaging loads are typically wrapped in film to contain a number of smaller units into a larger unit for simplicity of shipping. The wrapped packaging loads are loaded onto transportation vehicles and moved to a desired location. During transportation or loading, the wrapped loads are often subject to damage, amounting for billions of dollars of damages industry-wide.

Damage can result from improperly or inadequately wrapped loads. Loads are often wrapped with too little film or improperly placed wrapping. As such, the load can shift or move during loading or transportation operations, causing collapse of the wrapped load. Such collapses can cause further unforeseen other damages.

Typical film wrapping equipment does not account for a variety of aspects of the load to be wrapped, the film to be used, or the transportation characteristics the load will be subjected to. Aspects such as weight, size, transportation methods or differing film properties are not taken into consideration. As such, the human user tasked with wrapping the load or operating the wrapping equipment must guess at how much containment force or wrapping pattern characteristics are adequate, often providing too much or too little film to at least a portion of the load. Furthermore, automatic mechanical wrapping equipment often improperly wraps the load, having too much film around the top and bottom of the load while inadequately wrapping the middle of the load.

BRIEF DESCRIPTION OF THE INVENTION

In one aspect, method of applying a stretch film wrap to a load includes loading the load on a load support of a film wrapping apparatus, loading a film roll having a discrete stiffness in a film dispenser carriage, and receiving in a controller operably coupled with the film dispenser carriage and the load support, data representing the discrete stiffness of the film. The method further includes determining a wrapping pattern for the load based at least in part on data representing the discrete stiffness of the film, moving the load support or the film dispenser carriage relative to the other to apply the film to the load according to the wrapping pattern; and measuring the film while moving the load support or the film dispenser carriage relative to the other to generate the data representing the discrete stiffness of the film.

In another aspect, a system for applying a stretch film wrap to a load includes a load support, a film dispenser carriage disposed adjacent the load support having film with a discrete stiffness to wrap a load on the load support, first and second non-powered rollers to feed the film to the load, and a sensor on each of the first and second non-powered rollers for measuring the film to generate data representing the discrete stiffness of the film. A controller is operably coupled with the load support and the film dispenser carriage, and the controller is configured to receive data representing the discrete stiffness of the film generated by measuring the film while moving the load support or the film dispenser carriage relative to the other to generate the data representing the discrete stiffness of the film. The controller is further configured to determine a wrap pattern for the load based at least in part on the data representing the discrete stiffness, so that the controller can operate the load support or the film dispenser carriage according to the wrapping pattern to wrap the load.

Another aspect is a method of applying a stretch film wrap to a load that includes loading the load on a load support of a film wrapping apparatus, loading a film roll in a film dispenser carriage, receiving in a controller operably coupled with the film dispenser carriage and the load support, data about the load, data representing the discrete stiffness of the film, and data about prospective transportation of the load. A controller determines an overall recommended containment force for the load based on data about the load, data representing the discrete stiffness of the film, and data about prospective transportation of the load, and determines a containment force per layer for the film based on the data about the load and the data about prospective transportation of the load. The controller also determines a wrapping pattern for the load based on the overall recommended containment force and the containment force per layer, and a width of the film. The method further includes moving the load support or the film dispenser carriage relative to the other to apply the film to the load according to the wrapping pattern, and measuring the film while moving the load support or the film dispenser carriage relative to the other to generate the data representing the discrete stiffness of the film.

In another aspect, a system for monitoring and controlling the application force of a stretch film includes one or more film tensioning rollers to stretch film before applying the film to a load, a non-powered roller to feed the film to the load, a dancer bar carrying a dancer roller disposed between the at least one film tensioning roller and the non-powered roller and pivotably mounted so that the dancer roller pivots relative to the at least one film tensioning roller to apply to tension to the film, and a spring coupled to the dancer bar to bias pivotal movement of the dancer bar toward or away from the film tensioning roller. An actuator is coupled to the spring to affect the bias of the spring on the dancer bar. A sensor is disposed to measure the position of the dancer bar, and a controller is operably coupled to the actuator and communicatively coupled to the sensor to determine the position of the dancer bar. The controller can actuate the actuator coupled to the spring to increase or decrease the bias of the spring on the dancer bar to position the dancer bar relative to the at least one film tensioning roller measured by the sensor, increasing or decreasing film payout speed from the at least one film tensioning roller to increase or decrease a tension of the stretch film.

DETAILED DESCRIPTION

Figure 1:
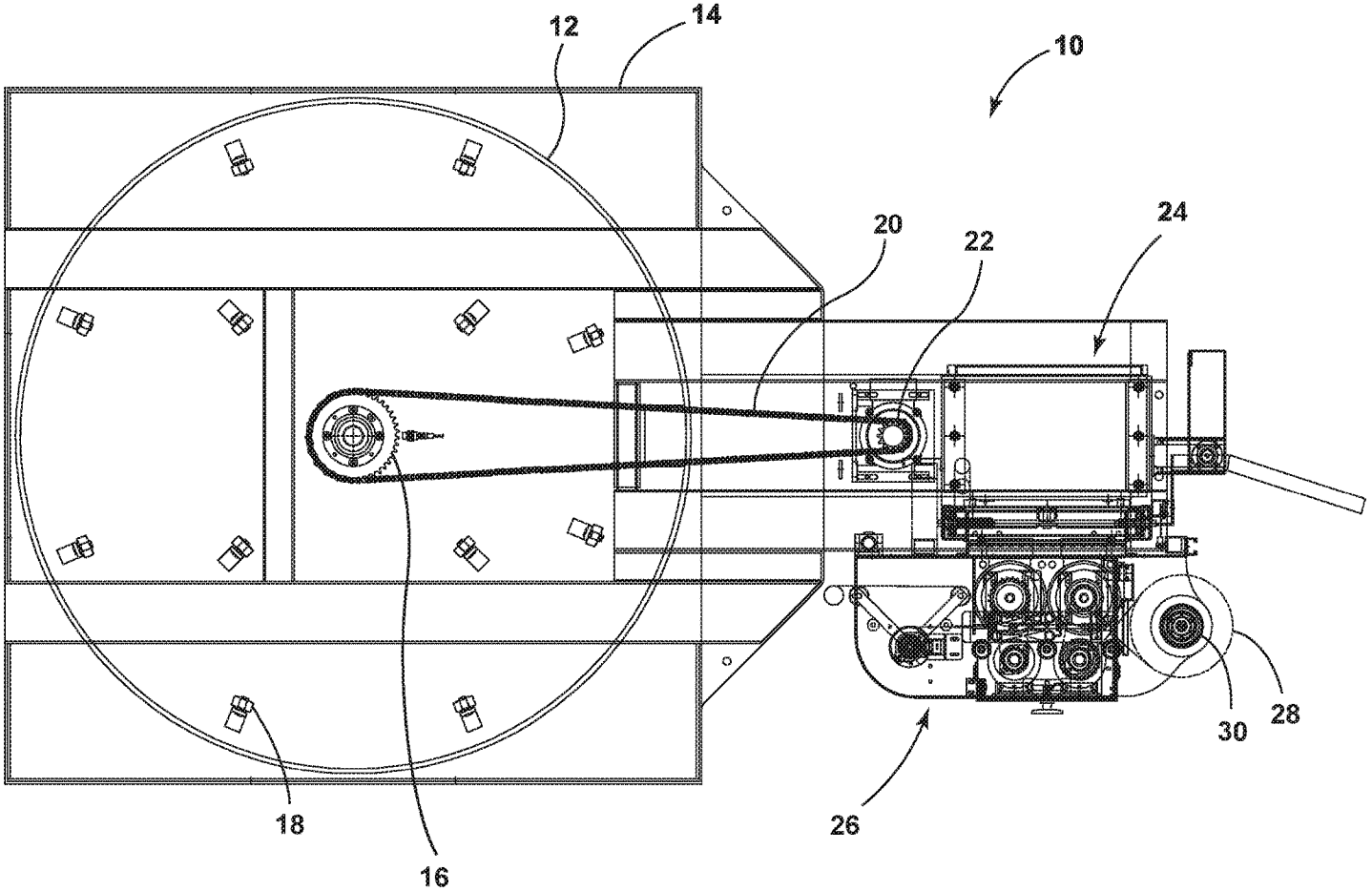
FIG. 1 is a top view of a film wrapping apparatus with a turntable and a film dispenser carriage.
Figure 2:
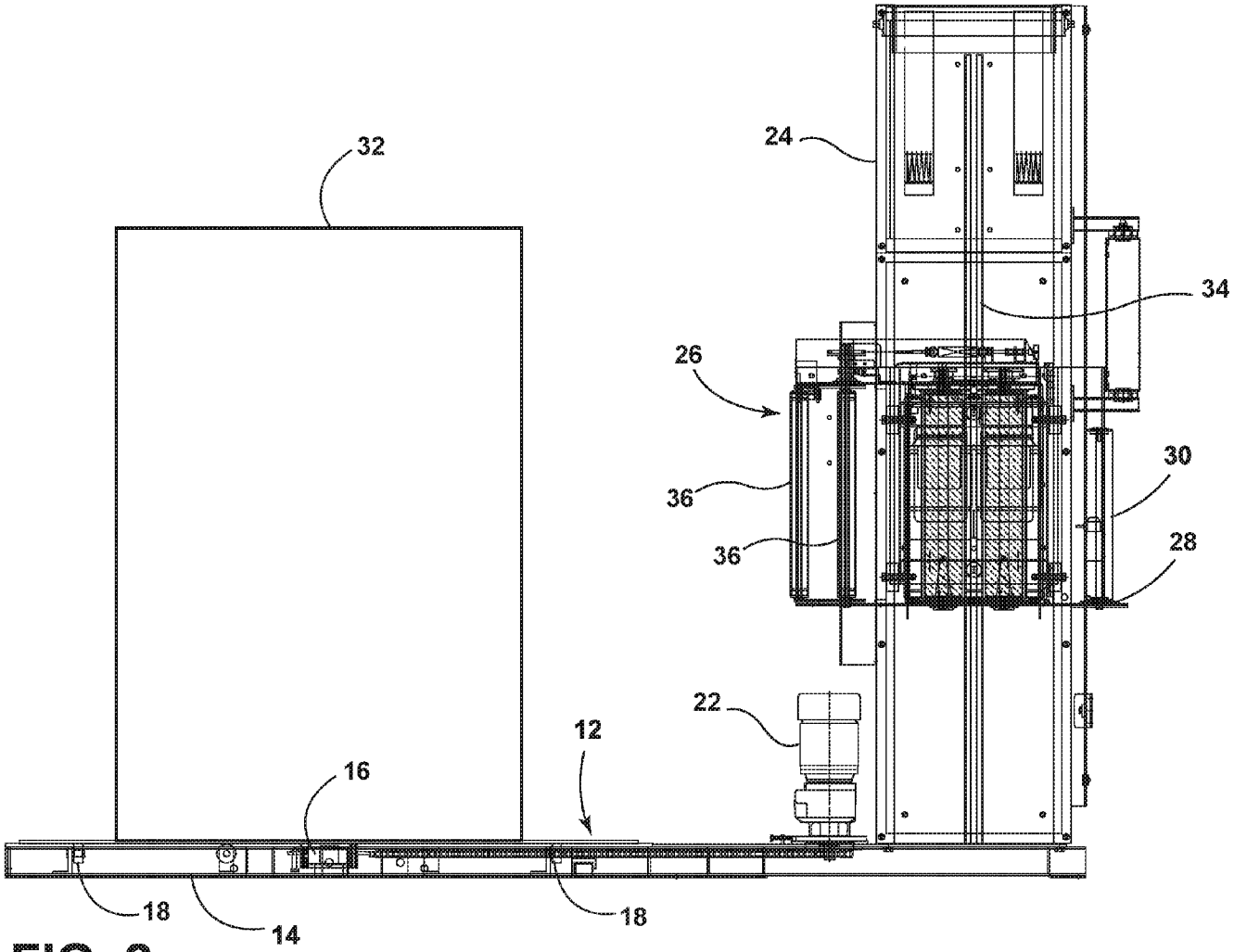
FIG. 2 is a side view of the film wrapping apparatus of FIG. 1

Looking first at FIGS. 1 and 2, a film wrapping apparatus 10 comprises a turntable 12 mounted on a platform 14. The turntable 12 is normally rotatable around a central driver 16, such as a gear, sprocket, wheel or drive pulley, and can rotate relative to the platform 14 on a plurality of wheels 18 disposed between the platform 14 and the turntable 12. A chain or belt 20 coupling the turntable 12 to a motor 22 can rotate the turntable 12, driving the central driver 16. The film wrapping apparatus 10 further comprises a vertical body 24 for mounting a film dispenser carriage 26 thereto, such that one end of the film dispenser carriage 26 is disposed adjacent to the turntable 12. Additionally, the body 24 can house additional components such as a controller, electrical connections, and internal mechanical components for operating the film wrapping apparatus 10. A film platform 28 is disposed on the film dispenser carriage 26 for holding a roll of film 30 for application to a load. The film 30 can further comprise a stretch film capable of being stretched during application to the load such that the film 30 can be tensioned to provide a tensioned force to hold the wrapped load. The film 30 runs through the film dispenser carriage 26 such that the film 30 can be dispensed to the load from the film platform 28 in a controlled manner through the film dispenser carriage 26. It will be understood that aspects of the invention are not limited to the aforementioned embodiment. Rather the disclosure herein is equally applicable to any load wrapping apparatus of the type configured to wrap a load on a load support with packaging material dispensed from a packaging material dispenser through relative rotation between the packaging material dispenser and the load support.

In FIG. 2, a side view of the film wrapping apparatus of FIG. 1 is shown including an exemplary load 32 disposed on the turntable 12. The load 32 can be a composition of multiple discrete items to define a collective load 32, or it can be a single item. The load 32 can further be disposed on top of a support, such as a pallet, slip sheet, skid, or other platform typically used for product transportation and delivery. The vertical body 24 additionally comprises a track 34, such that the film dispenser carriage 26 can be moved along the track in a vertical manner. Actuation of the film dispenser carriage 26 along the track 34 can dispense film 30 to the entire height of the load 32. The film dispenser carriage 26 can further comprise a plurality of rollers 36, powered and non-powered, for selective and controlled dispensing of the film 30 to the load 32. For example, the film dispenser carriage 26 can include a first non-powered roller and a second non-powered roller where the rollers are measured by sensors to determine a length of film passing over the rollers. There may also be a spring-tensioned roller applying a force to the film between the rollers. Measurements of the length of the film passing over the rollers and the determined force applied by the spring-tensioned roller can be utilized to determine the stiffness, relative stiffness, strength, or relative strength of the film being applied to the load 32.

It should be appreciated that during operation, the load 32 for packaging is placed on the turntable 12 and the roll of packaging film 30 is placed on the film platform 28. The film 30 on the film platform 28 is fed through the rollers 36 of the film dispenser carriage 26 and out onto the adjacent load 32 on the turntable 12. Thus, as the turntable 12 is rotated, the load 32 is rotated, such that film 30 can be fed through the film dispenser carriage 26 and onto the load 32 in a manner controlled by the rollers 36 of the film dispenser carriage 26. Additionally, the vertical location of the film dispenser carriage 26 can move along the track 34 on the body 24 such that film 30 can be dispensed over the entire height of the load 32. As film 30 is dispensed, the load 32 is wrapped in the film 30 around the sides of the load 32 by the rotating motion of the turntable 12 and the vertical motion of the film dispenser carriage 26 on the track 34. The speed of the film dispense carriage 26 may be controlled so as to apply a greater number of film layers and or to adjust overlap between film layers during rotation of the load 32. This process can be continued or repeated until the load 32 is sufficiently wrapped in film 30.

While FIGS. 1 and 2 show and describe a turntable stretch wrapper, it will be understood that the invention is not so limited and may also apply to other wrappers such as rotary arm stretch wrappers and orbital stretch wrappers. A rotary arm stretch wrapper leaves the load stationary while a pivoting arm carrying the film carriage rotates around it. An orbital stretch wrapper works in a similar way but uses a rotating ring or a shuttle on a stationary ring to revolve around the load during wrapping, where the relative motion between the load and wrapping ring may be vertical or horizontal.

Figure 3:
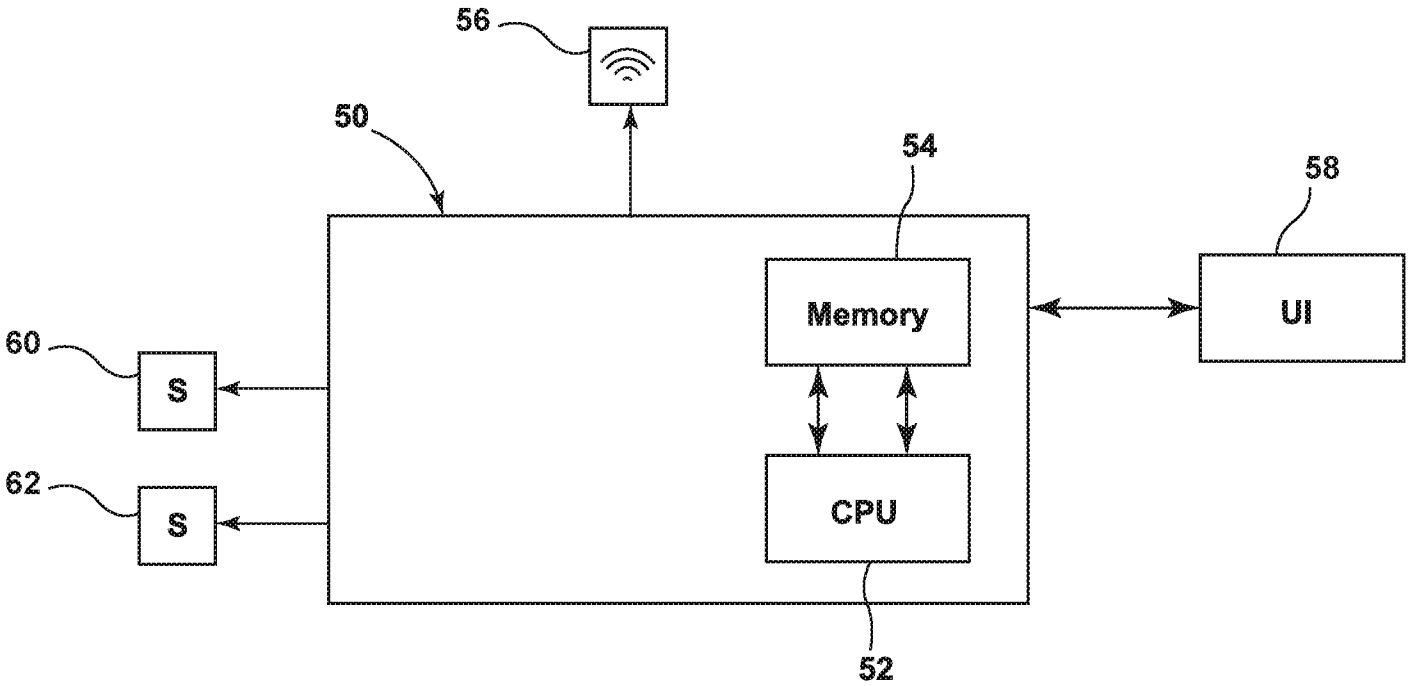
FIG. 3 is a schematic illustration of a controller utilized within the film wrapping apparatus of FIG. 1.

Turning now also to FIG. 3, a schematic of an exemplary controller 50 is shown. The controller 50 can be housed anywhere in the film wrapping apparatus 10. Alternatively, the controller 50 can be housed in a remote station utilized to remotely control one or more film wrapping apparatuses 10 by wired or wireless communication. Furthermore, the controller 50 can be incorporated into a mobile device, such as a handheld wireless device, such that the film wrapping apparatus 10 is capable of remote or wireless communication via the controller 50. As such, the controller 50 can further comprise or be operably coupled with a transceiver 56 to enable wireless communication.

The controller 50 comprises a module such as a central processing unit (CPU) 52, and a memory 54. The CPU 52 can be used to execute a software program of operation for operating one or more film wrapping apparatuses 10 and the memory 54 can be used for storing information such as the software program of operation to be executed by the CPU 52. Additionally, the memory 54 can be used to store data particular to the film 30, the load 32, the film wrapping process, and operation of the film wrapping apparatus 10. Such data can include historical load information, apparatus performance, historical film data, specifications about the film itself, or related equations and relationships. Additionally, the controller 50 can operably couple with a data receiver, such as a user interface 58, such that the user can input data for operating the film wrapping apparatus 10 with the controller 50 by inputting commands, data, or controls at the user interface 58. This data may also be stored externally or input via controls such as touch screens, buttons, switches, potentiometers, etc. Examples of input commands, data, or controls can include but is not limited to data about the load 32 and prospective transportation of the load 32, and data about the film 30 used to wrap the load 32. Alternatively, the user interface (UI) 58 can be located remotely from the controller 50, being in communication with the controller 50 by wired or wireless communication from the remote location or over an internet connection. Such an example can include a user interface on a mobile device or website, wirelessly communicating with a controller 50 disposed within the film wrapping apparatus 10 via the transceiver 56.

The controller 50 can include the machine controller and any additional controllers provided for controlling any of the components of the film wrapping apparatus 10 and associated equipment. For example, the controller 50 can include the machine controller and one or more motor controllers. Many known types of controllers can be used for the controller 50. The specific type of controller is not germane to the invention. It is contemplated that the controller 50 is a microprocessor-based controller or programmable logic controller that implements control programs and or software and sends/receives one or more electrical signals to/from each of the various working components to affect the control programs and or software. The controller 50 is provided with the memory 54 for storing control programs and or software that is executed by the central processing unit 52 of the controller 50 in completing an operation of the film wrapping apparatus 10 and any additional programs and or software.

The controller 50 can further communicatively couple to one or more sensors, exemplarily illustrated as a first sensor 60 and a second sensor 62. The sensors 60, 62, in non-limiting examples can comprise weight sensors, laser sensors, sensors for monitoring the film dispenser carriage 26, etc. The sensors 60, 62 can be configured to measure dimensional changes in the film 30 as it is applied, such as how much the film stretches, as well as force acting on the film during stretching. Utilizing the controller 50 in combination with the sensors 60, 62 enables the controller 50 to operate the film wrapping apparatus 10 based upon the measurements taken by the sensors 60, 62 and data in the memory 54. As such, the film wrapping of the load 32 can be particularly tailored to the particular load 32 and film 30 as determined by the sensors 60, 62 rather than by the user or in addition to the user, where user input data alone may not yield efficient results and or may increase the risk of load damage attributable to a degree of human error. The information provided to the controller 50 by the sensors 60 and 62 may be overridden by manual user input or otherwise stored information or settings if and when desirable.

Figure 4:
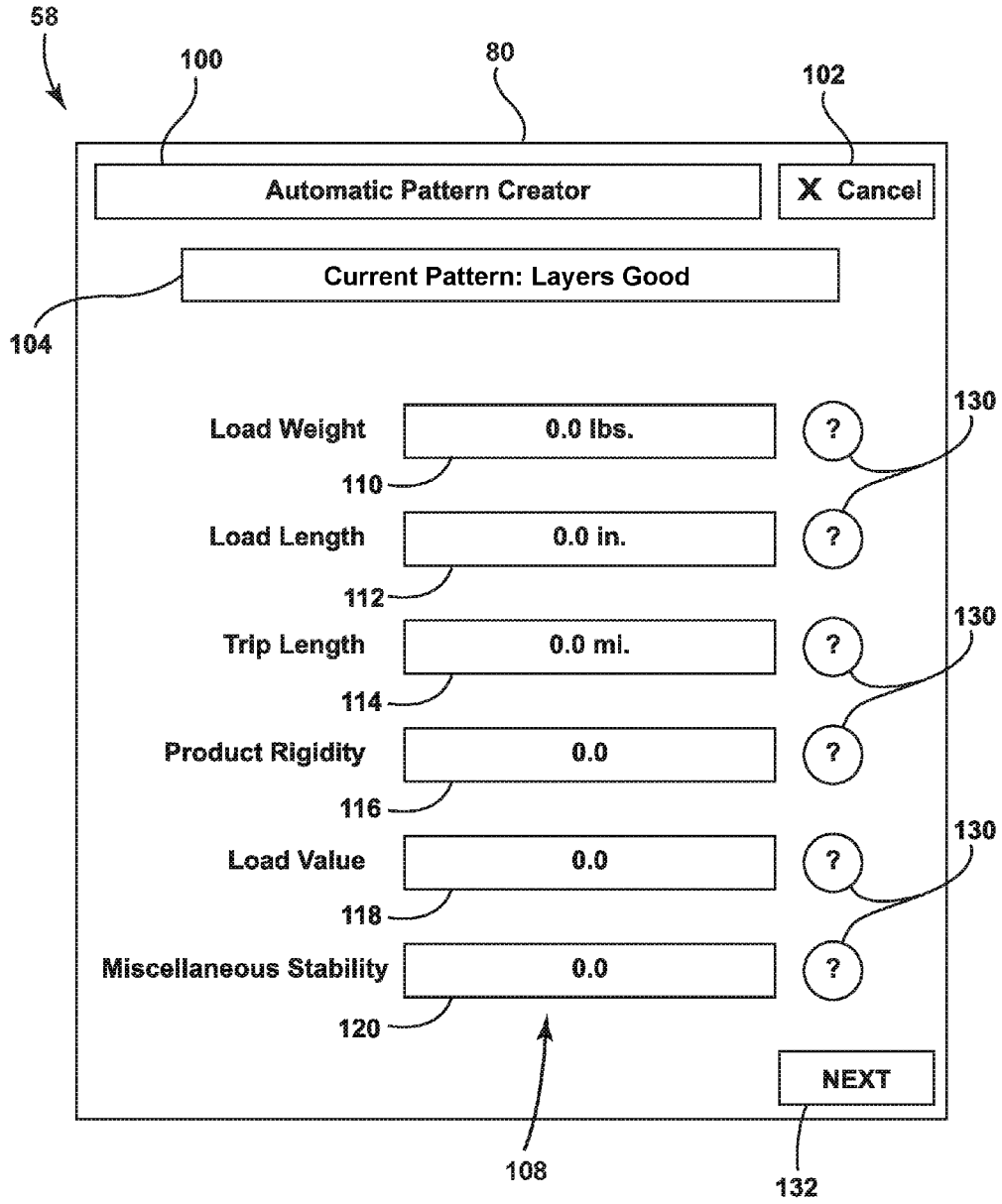
FIG. 4 is an exemplary user interface for inputting data regarding the film wrapping apparatus or the load.

Turning to FIG. 4, an exemplary display 80 for the user interface 58 is illustrated which can display a software program operated by the controller 50 for wrapping the load 32 with the film 30. The display 80 can include a title 100, an exit function 102, and a result 104. The title 100 can display an overview of the program being run, the exit function 102 can exit the current program, and the result 104 can be representative of a determination or calculation made by the program. The display 80 can further include one or more inputs 108, exemplarily illustrated as a weight input 110, a length input 112, a trip length input 114, a rigidity input 116, a monetary value input 118, and a stability input 120. The inputs 108 can be manually entered by the user or can be determined by one or more of the sensors 60, 62, as can be determinable by the sensors 60, 62, and automatically entered by the controller 50. For example, in the case of an automatic input determination by one sensor 60, a weight sensor disposed on the turntable 12 or the platform 14 can calculate the load weight. The measured weight of the load 32 can be automatically inputted into the weight input 110 without the need for the user to weight the load 32 before moving the load to the film wrapping apparatus 10. Additionally, this can enable the user to add items to or remove items from the load 32 without the need to re-weigh the load 32 or re-enter a new weight input 110. It could be conceived and may be desirable that a stretch wrapping system 10 may be able to automatically sense or input enough load, film, and transportation information automatically that a human user input is not required to determine a desirable containment force and wrapping pattern. Alternatively, in the case of an automatic input, a barcode scanner, QR code scanner, or RFID reader could be utilized to read a label or identifier on the load 32 and identify one or more properties about the load, retrieving it from its memory or from a database. Additionally, each input 108 can have an adjacent help function 130 for assisting in properly inputting values into the inputs 108. Furthermore, the help function 130 can act as a switch for changing the input style from manual to automatic or even the particular type of input as such data is available. A next function 132 can be utilized to calculate a proper wrapping pattern based at least in part upon the inputs 108. The determined pattern can be identified in the result 104 display potentially informing the user whether the current pattern will appropriately wrap the load 32 based upon the inputs 108. The result 104 may be an explicit determination of wrap pattern appropriateness or may provide information by which a human operator may interpret the appropriateness of the wrapping pattern. The content of the result 104 may be reference data, scores, written descriptions, or any other information to describe the properties of the wrapping pattern's current, past, or potential qualities.

It should be understood that the display 80 of FIG. 4 is for illustration purposes only, and can vary from the particular layout, design, inputs, functionalities, etc. as shown. The weight, length, trip length, rigidity, value, and miscellaneous stability are exemplary inputs 108. The display 80 can include more or less inputs 108, or alternative inputs 108 such as, but not limited to, the three-dimensional representations of the load 32 such as length, width, and height, the stacking pattern, the shipping method, the phase of load, such as solid or liquid, the film stiffness, and the film force per layer. The method of inputting values into the inputs 108 can be alternative as well, such as limited to choices selected from a drop-down list rather than an inputted value. The inputs 108 can be entered at the user interface 58 by a plurality of methods, which can include knobs, dials, switches, keyboards, voice recognition, touch screens, and the like for communicating with the user, in non-limiting examples. The interface may be a touch-screen or physical control panel housed on the machine body 10, mounted remotely, contained within a database, or be contained within a wireless or mobile device or web interface. The particular implementation, layout, or design of the user interface 58 is not germane to the invention.

Figure 5:
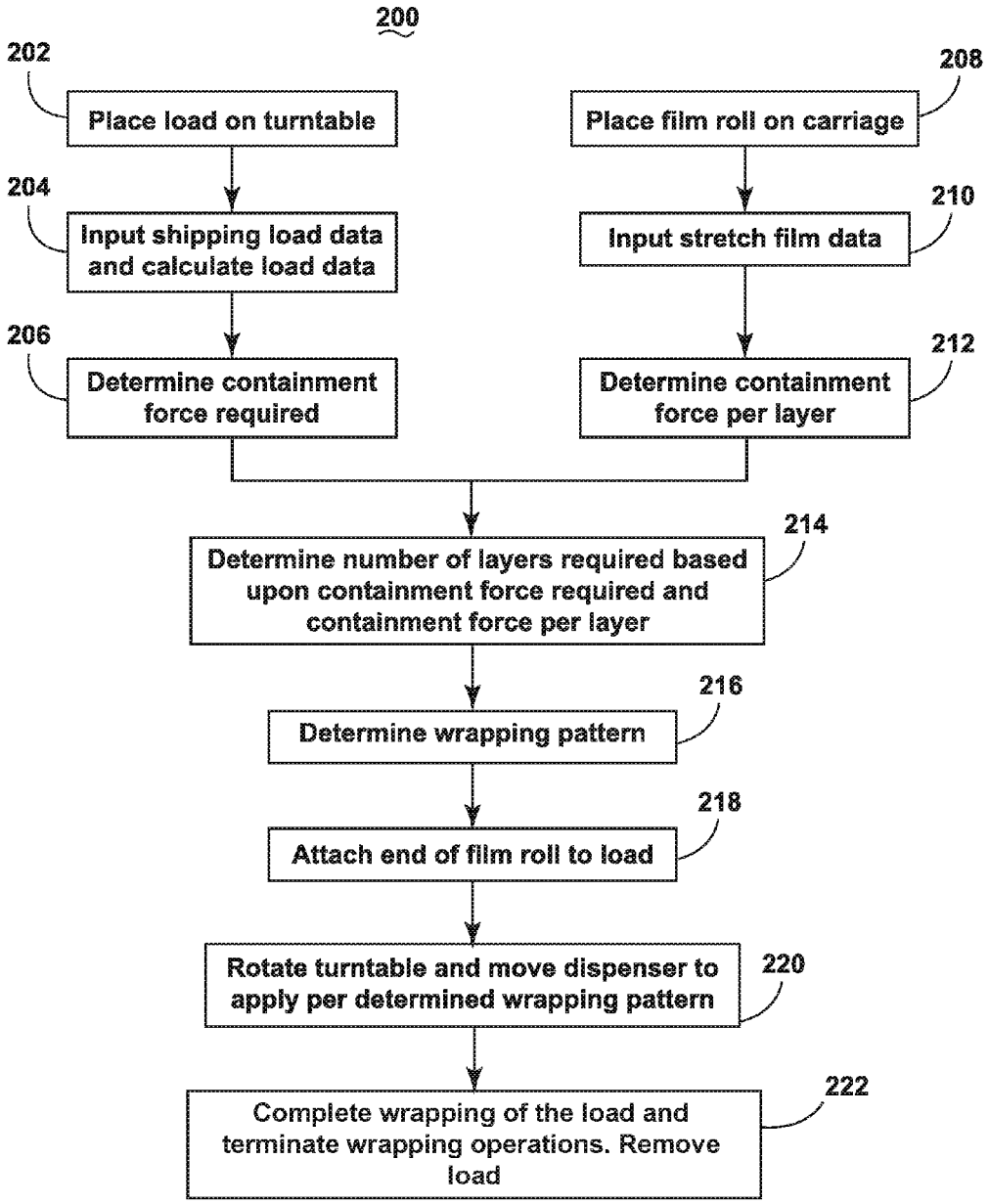
FIG. 5 is flow chart illustrating an embodiment of a method for applying a stretch film wrap to a load.

FIG. 5 is a flow chart illustrating a method 200 for wrapping the load 32 utilizing the film wrapping apparatus 10. At 202, the load 32 is placed on the turntable 12. The load 32 can be pre-assembled, such as stacked, organized, or packaged, or can comprise multiple individual pieces, individually loaded onto the turntable 12 in a piece-wise manner such that the load 32 is created. At 204, data related to the load 32 and shipping can be input at the user interface 58 of FIG. 4. Additionally, at 204, the load data can be calculated based upon one or more sensors 60, 62, such as a weight sensor, disposed on the film wrapping apparatus 10. Such load data can be entered into the user interface 58 automatically by the controller 50 in communication with the sensors 60, 62. The data can be predetermined prior to the loading of the load 32 onto the machine 10 and communicated to the machine before or after the load 32 is loaded onto the machine 10. At 206, the data can be utilized to determine a containment force required for the load 32. The containment force is the force required by the film 30 to properly secure the load 32 such that the risk of load damage from wrapping failure is minimized during transportation. Other parameters for what containment force is appropriate or required for each load may be utilized, including but not limited to maintaining product stability and load geometry, avoiding crushing or damaging product, wrapping the load most quickly while achieving other desirable results, etc.

Before, after, or simultaneous with steps 202, 204, and 206, steps 208, 210, and 212 can be completed. At 208, the user can place a roll of film 30 on the film platform 28 of the film dispenser carriage 26. Additionally, the film 30 can be pre-fed through the rollers 36 on the film dispenser carriage 26 such that the film dispenser carriage 26 is prepared to wrap the load 32. At 210, based upon the film 30 used, the user can input data related to the film 30 into the user interface 58. The film inputs may be sensed by the machine before during or after wrapping and be relayed automatically or by manual input to the controller 50 of the machine 10. At 212, the software program utilized by the controller 50 can determine the containment force per layer of the film 30 based upon the film data entered at the display 80 or that has been collected by sensors, databases, or other means. Containment force is commonly measured by use of a pull plate test or similar tool wherein the film is applied to the load, the tool is placed between the load and the wrapped film, and the tool is pulled away from the load or otherwise causes a motion wherein at least a portion of the tool moves away from the load surface and at least a portion of the tool stretches the wrapped film to some extent. A measurement is taken for the force required to make this movement or movements. Containment force is influenced by the tension on the film and the stiffness or strength of the film. Other film properties may influence containment force as well including, but not limited to, cling, static holding force, and elasticity.

At 214, upon making the determination of the containment force required at 206, and the containment force per layer at 212, the controller 50 can determine the number of layers required to achieve the total containment force to wrap the load 32 on any point, multiple points, or all points on the load 32. At 216, based at least in part upon the number of layers required to achieve the desired total containment force, the controller 50 can determine a wrapping pattern for the load 32 to achieve the appropriate containment force around the entire body of the load 32. This can include additional wrapping layers near the top or bottom of the load 32 where alternative containment forces may be desired. The amount of layers near the top and bottom of the load 32 can be further determined as part of the wrapping pattern based upon particular inputs 108, such as whether the load 32 is solid or liquid. In one example, where the load 32 is liquid, transportation can cause increased discrete momentum of the load 32 as the liquid within the load 32 moves with the transportation vehicle, such that additional wrapping near the top and bottom can be necessary to prevent load collapse, where a solid load might not have such a problem. It should be appreciated that the inputs determine at least part of the particular wrapping pattern, being particularly tailored to the unique load being wrapped.

At 218, after determining a proper wrapping pattern for the load 32, an end of the stretch film roll, fed through the film dispenser carriage 26, attaches to the load 32 and the film wrapping apparatus 10 is prepared to wrap the load 32. At 220, the film wrapping apparatus 10 is operated and the load 32 is wrapped by rotating the turntable 12, rotating the load 32, and actuating the film dispenser carriage 26 along the track 34 such that the load 32 is wrapped according to pattern determined by the controller 50. At 222, the wrapping pattern is completed around the load 28 and film wrapping is terminated. The load 32 is removed from the turntable 12 and prepared for transportation.

It should be appreciated that the steps illustrated in FIG. 5 can be completed in alternating orders. For example, steps 208, 210, and 212 can be completed prior to steps 202, 204, and 206. In an additional example, step 218 can take place directly after step 202. Additionally, some steps can be removed or additional steps can be added. Furthermore, steps can be combined or dissected as necessary to facilitate the film wrapping method.

Figure 6:
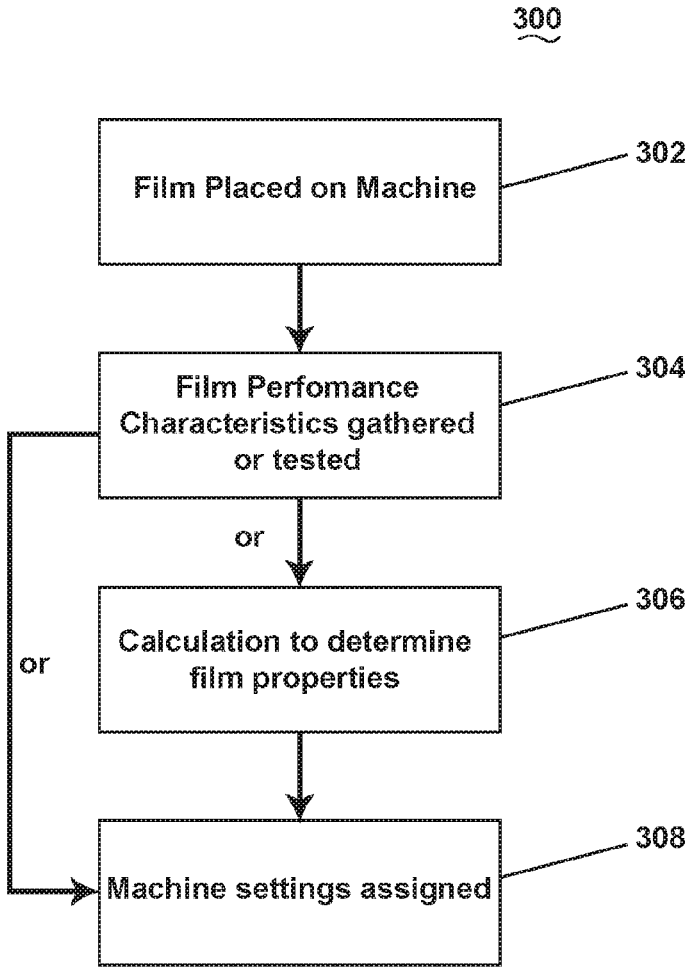
FIG. 6 is flow chart illustrating another embodiment of a method for applying a stretch film wrap to a load based on the stiffness of the stretch film.

Turning now to FIG. 6 another embodiment 300 of the method is illustrated. It will be understood that the stiffness of the film 30 being applied to the load 32 can be utilized to determine, at least in part, an appropriate pattern for the film 30 to be applied to the load 32 such that effective wrapping of the load 32 is achieved. Film stiffness is the amount of force required to make a positive dimensional change in the film, typically stretching the film further than its current state in the machine direction of the film. It should be appreciated that measuring the stiffness of the film is beneficial to properly implementing a wrapping pattern on a load, recommending a wrapping force, or recommending a pre-stretch level for the film. A load can be properly wrapped with an amount of film, however, it can still be subject to load failure if the film is not applied with the appropriate tension to maintain the geometry of the items comprising the load. Additionally, as the film dispenser carriage 26 can vary the tension of the film 30 dispensed therefrom, it is further beneficial to measure the discrete stiffness of the film as being applied to the load. For example, a layer of film near the top or bottom of the load may require increased or decreased tension while middle layers may not require the same amount of tension from the film. Furthermore, a relatively heavy weight load may benefit from or require the film be wrapped at a high tension. A relatively light weight load may benefit from or require light film tension. Furthermore, inner layers of film may require less tension in order to prevent film breakage on the load, while outer layers may have more tension in order to properly secure the load. Alternatively, inner layers may require more tension, while outer layers may have less tension to provide better abrasion resistance. These examples are not meant to limit the potential benefit of wrapping with discrete wrapping forces or stretch levels at different points within the wrap pattern. The advantages of measuring the film stiffness as applied to the load can provide a benefit to determine a particular wrapping pattern tailored to a particular load. Thus, a more precise wrapping pattern can be determined and load failure, load damage, and film failure can be minimized.

In the method 300, the film 30 is placed on the film wrapping apparatus 10 at step 302. It is assumed that the load 32 is placed on the turntable 12 before, during, or after method 300 is executed. As before, the load 32 can be pre-assembled, such as stacked, organized, or packaged, or can comprise multiple individual pieces, individually loaded onto the turntable 12 in a piece-wise manner such that the load 32 is created. The memory 54 of the controller 50 may have data about the film 30, including inherent characteristics of the film, such as the stiffness of the material. The film 30 will be fed or attached to the load 32 and the turntable 12 commences rotating. While the film 30 is being dispensed, the sensors 60, 62 measure stretch or length/speed change of the film, force or tension on the film, and/or wrapping force or tension on the load 32. Other measurements may be taken and utilized in addition to or replacement of these measurements. As the load is being wrapped, the controller is gathering data about the film stiffness from the memory 54 and/or from the sensors 60, 62 at step 304. Based on the characteristics of the film gathered from the memory 54 and/or from the sensors 60, 62, the controller 50 can determine the film characteristics (such as film stiffness) at step 306 and then assign the settings for a particular wrap pattern based on the film characteristics at step 308. It is also feasible that known film characteristics can be correlated to predictable performance characteristics. If such data is in the memory 54, and if the controller identifies the loaded film by a sensor or other data input, the controller 50 may simply assign values to at least in part create a wrap pattern at step 308 without determining the film characteristics at step 306. In either case, the sensors 60, 62 can continue to monitor the wrapping to ensure that the determined wrapping pattern is accurately executed, and/or that the film properties are as expected at the current moment and over time.

Figure 7:
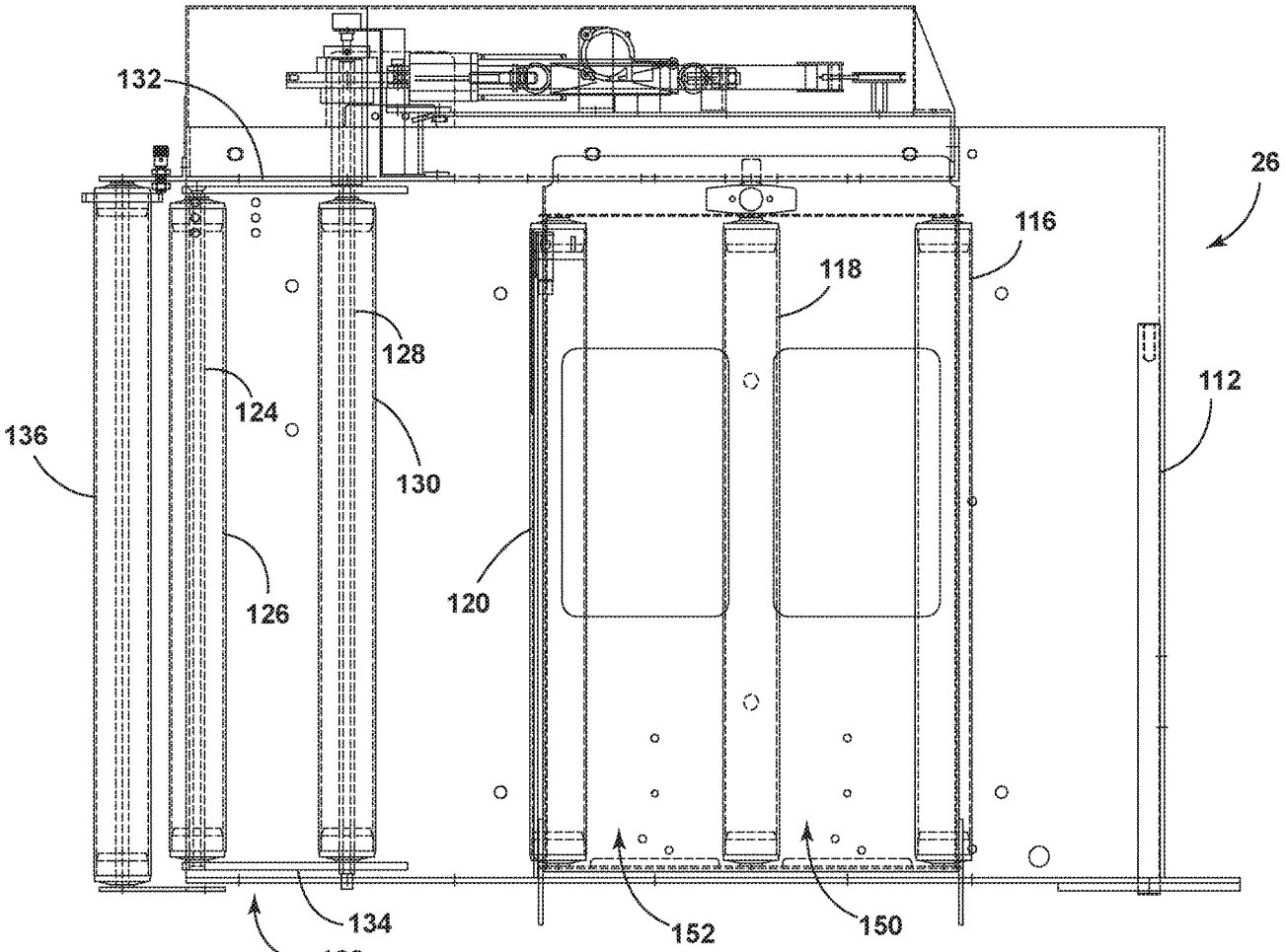
FIG. 7 is a side view of the film dispenser carriage of FIG. 1.

Turning now to FIG. 7, a side schematic view of the film dispenser carriage 26 illustrates a plurality of rollers through which the film 30 can be fed. A vertical shaft comprises a spindle 112 for holding a roll of stretch film 30. The spindle 112 couples to the film platform 28 on which the film 30 can rest. The spindle 112 and the film platform 28 can rotate such that film 30 from a roll of film can be fed through the film dispenser carriage 26. The film may be held within the carriage by other means such as end caps or any device which holds the film 30 and allows it to rotate within the film dispenser carriage 26. The film 30 being fed from the spindle 112 is fed through a pre-stretch section 114 comprising one or more prestretch rollers, illustrated as a first pre-stretch roller 150 and a second pre-stretch roller 152. Downstream of the first and second pre-stretch rollers 150, 152 is a first non-powered roller 120, adjacent to the pre-stretch section 114. There may also be one or more guide rollers 116, 118 to guide the film in the pre-stretch section 114, these guide rollers 116 and 118 may be powered or non-powered. The number order and placement of the rollers may be altered.

A dancer assembly 122 receives the pre-stretched film from the first non-powered roller 120 after the pre-stretch section 114. The dancer assembly 122 comprises a dancer bar 124 with a dancer roller 126 rotatably disposed around the dancer bar 124. The dancer bar 124 couples to a fixed roller bar 128 having a middle roller 130, by a first shaft 132 and a second shaft 134 disposed at the tops and bottoms, respectively, of the dancer bar 124 and the roller bar 128. The roller bar 128 and the middle roller 130 are disposed within the dancer assembly 122 and upstream of the dancer bar 124 and dancer roller 126, closer to the spindle 112 relative to the longitudinal length of the film dispenser carriage 26 (See FIG. 5). The dancer assembly 122 can pivotably rotate closer to or further from the first non-powered roller 120 relative to the fixed roller bar 128 via the shafts 132, 134. A typical range for such pivoting movement is from 0 to 180 degrees. Consequently, length of the film 30 between the dancer bar 124 and the roller bar 128 remains constant, while the length of the film 30 between the dancer bar 124 and the first non-powered roller 120 can change based upon pivoting movement of the dancer assembly 122. Thus, the dancer assembly 122 can operate to increase or decrease the relative tension of the film 30 passing over it by moving further from or closer to the first non-powered roller 120, respectively.

Downstream of the roller bar 128 is a second non-powered roller 136 that can be disposed adjacent to the load 32. A length of film 30 fed from the second non-powered roller 132 can be fed directly to the load 32 for wrapping of the load 32. The length of film 30 may also be feed directly from the dancer bar roller 126.

A first sensor 140 may be disposed adjacent to or can couple to the first non-powered roller 120 and a second sensor 142 is disposed adjacent to or can couple to the second non-powered roller 136. Each sensor 140, 142 is exemplarily shown, and can be positioned anywhere adjacent to their respective rollers 120, 132 such that proper measurements can be made by the sensors 140, 142. The sensors 140, 142 can be adapted the measure the length of film 30 passing over a respective roller by any method, such as but not limited to, measuring the roller rotation, rate of rotation of the roller, length of the film passing over a portion of the roller, or measuring speed of roller surfaces or film speed located at each sensor position respectively. Exemplary sensors can be laser sensors, length sensors, or any other sensor which can accomplish a measurement of the length of film passing over a roller or related measurement.

Figure 8:
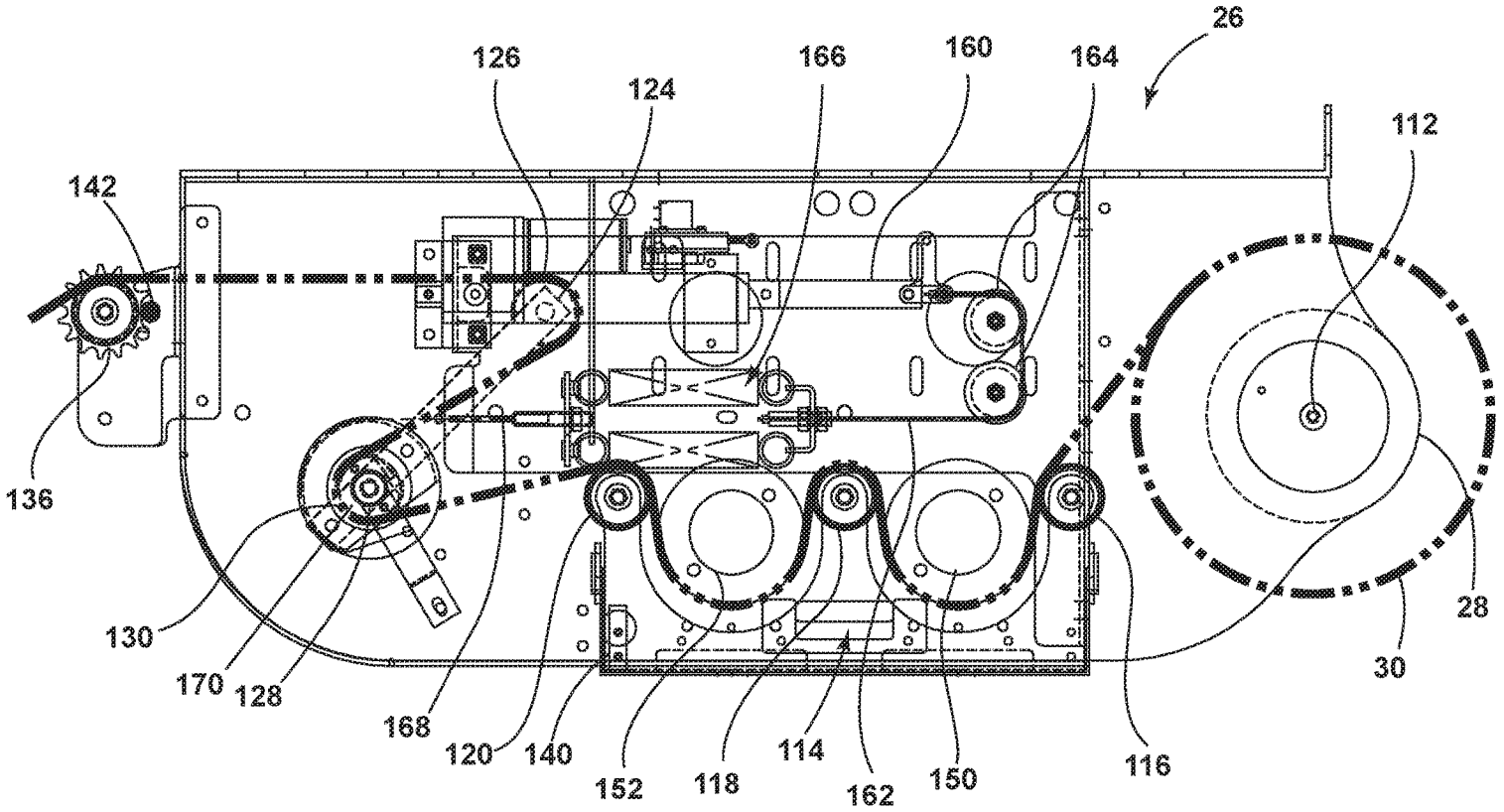
FIG. 8 is a top view of the film dispenser carriage of FIG. 7.

Turning to FIG. 8, a top view of the film carriage assembly 26 best illustrates the path of the film 30 moving through the components of the film carriage assembly 26. The film 30 moves from the spindle 112 into the pre-stretch section 114. The film 30 passes through the first and second guide rollers 116, 118, and passes around a first prestretch roller 150 between the first and second guide rollers 116, 118, and a second prestretch roller 152 disposed between the second guide roller 118 and the first non-powered roller 120. The first and second prestretch rollers 150, 152 can comprise vertical rotating members, similar to the rollers, driven by one or more motors. The prestretch rollers 150, 152 can be driven at different rates in order to stretch the film passing between them. For example, the second prestretch roller 152 can rotate at a speed greater than that of the first prestretch roller 150 to effectively stretch the film passing between them.

From the second prestretch roller 152, the film 30 is fed to the first non-powered roller 120. The first sensor 140 can take measurements of the film 30 passing over the first non-powered roller 120, such as length of film 30 passing over the roller over time, or the rate at which the first non-powered roller 120 is rotating. From the first non-powered roller 120, the film 30 passes to the dancer assembly 122, where the film can turn around the dancer middle roller 130 and pass to the dancer roller 126. From the middle roller 130, the film 30 passes to the second non-powered roller 136 where the film 30 can be fed to the load 32 on the turntable 12. The second sensor 142, can take measurement of the film 30 passing through the second non-powered roller 136, similar to that of the first sensor 140 and the first non-powered roller 120.

Alternatively, the first or second non-powered roller may be replaced by a powered roller or removed and be replaced in function by the either the first or second prestretch rollers 150, 152, or both. Both non-powered rollers may be replaced by powered rollers so long as the force measured between them is measured, ie having both a determined length change and a determined force yields no useful information specific to the film being used.

The design of all rollers is not germane to this invention except where otherwise noted, including the guide rollers 116, 118, the prestretch rollers 150, 152, the non-powered rollers 120, 136, the middle roller 130, and the dancer roller 126, as such they may have or exclude central shafts and bearings.

Alternatively, the second non-powered roller may be replaced by using the known, calculated, or measured length of film being applied to the unit-load being wrapped.

Alternatively, other dimensional changes in the stretchable film may be used instead of length change, such as a change in thickness or width.

In FIG. 8, the top view of the film dispenser carriage 22 further illustrates an actuator 160. The actuator 160 couples to a pulley 162, strung around a set of two wheels 164. The pulley 162 runs around the wheels 164 and couples to a set of two springs 166. The actuator may be any system to preload the springs and hold them at a constant position for at least a portion of the wrap pattern, such as a powered linear actuator, a hole and peg system, or a manual screw positioning system, etc. The springs 166 couple to the dancer assembly 122 by a cord 168. The pulley 162 and the cord 168 can be any cable-like member, which are not subject to stretching, such as a wire or chain. The pulley 162 or cams 164 can be of any size or shape.

The actuator 160 can be operated manually or by the controller 50 to actuate, effectively pulling or releasing the pulley 162. As the actuator 160 pulls the pulley 162, the springs 166 are tensioned or relieved of tension relative to the movement of the actuator 160. As such, the springs 166 can effect a force to tension the dancer assembly 122 with the cord 162. This force acts to pivot the dancer assembly 122 relative to the first non-powered roller 120, and thereby change the tension of the film 26 passing over the dancer roller 126. The force being effected on the dancer assembly 122 by the springs 166 can be measured, either by an additional third sensor 170, such as a pressure sensor coupled to the spring 166, can be received, or based upon a calculation by the CPU in the controller as determined by the position of the actuator 160 or the dancer assembly 122 or predetermined with a calibrated spring setting or rate, or based upon a calculation by the CPU in the controller by determining the position of the actuator with a known spring set or rate resulting in a known dancer bar force, or based upon a calculation by the CPU in the controller as determined by commanding a know dancer bar assembly position within the dancer bars range resulting in a known force per dancer bar position about its axis. In the case of a third sensor 170, the controller 50 can communicatively couple to the third sensor 170. The sensor 170 can be a load cell, pressure sensor, distance sensor, or any other sensor capable of measuring information that can be used to determine the force acting on the film 30.

Dancer bar preload methods may include but are not limited to pneumatic actuation, hydraulic or hydraulically controlled actuation, electromagnetic actuation, mechanical spring, or elastomeric preload devices. This includes any calibrated or non-calibrated system designed to provide a force to the film web. The preload method may be controlled by the human operator, set by the controller 50, or received automatically.

Additionally, a target dancer bar angle or attitude may be set. The payout speed of the film may be adjusted from the prestretch section 114 or the actuator position may be adjusted in order to achieve the film tension required to maintain the target dancer bar angle, attitude or position. This position may be set by the operator or specified by the machine.

Alternatively, in place of a known force working on a dancer bar a measured force may be taken from any sensing method which may include but is not limited to a load cell or cells or any other sensor, which can take a measurement of the force of film passing over a roller or sensor of any kind. Additionally, a sensor such as a load cell or of any other type may be paired with a dancer bar, actuator, or positioning system to determine a force relative to position, angle, or attitude of said dancer bar or positioning system.

Additionally, the measurements of the first and second sensors 140, 142 can determine data signals representative of the length of the film passing over the non-powered rollers 120, 136 and the force applied to the dancer assembly 122 by the springs 166. The data signals can be sent to the controller 50 to determine a current tension of the stretch film 30. With this information, the user or a software program can operate the actuator 160 to increase or decrease the bias on the dancer bar 124, or increase or decrease the film payout speed from the stretch section 114 to increase or decrease the tension of the stretch film 30. A software program stored within the memory of the controller 50 can utilize the data signals to determine an appropriate wrapping pattern to effectively wrap the load 32 for transportation.

Furthermore, the controller 50 can implement a wrapping pattern to wrap the load 32 in one or more layers of film 30. As such, the particular wrapping pattern may require an increase or decrease in tension of a stretch film 30 being applied to a load 32. Thus, the actuator 160 can increase or decrease the film tension from the pre-stretch assembly 114 by biasing the dancer assembly 122. Increasing or decreasing the tension from the dancer assembly can increase or decrease the tension of the film 30 being applied to the load 32. Thus, for example, a particular wrapping pattern may require an increased tension film to be applied toward the top and bottom of the load 32. While wrapping the load 32 per a determined wrapping pattern, the actuator 160 can bias the dancer assembly 114 to increase the tension of the film 30 being applied near the top and bottom of the load 32 as the film dispenser carriage 26 moves adjacent to the top and bottom of the load 32. Additionally, the actuator 160 can decrease the tension of the film 30 by biasing the dancer assembly 114 when the film dispenser carriage 26 moves adjacent to the middle of the load 32. As can be understood, a particular wrapping pattern can be achieved having variable film tensions at different positions or layers of the film wrapped on the load 32.

Alternatively, in place of a known force working on a dancer bar a measured force may be taken from any sensing method which may include but is not limited to a load cell or cells or any other sensor, which can take a measurement of the force of film passing over a roller or sensor of any kind. Additionally, a sensor such as a load cell or of any other type may be paired with a dancer bar or positioning system to determine a force relative to position, angle, or attitude of said dancer bar or positioning system.

It should be appreciated that varying the tension of the film is beneficial to properly implementing a wrapping pattern on a load. A load can be properly wrapped with an amount of film, however, can still be subject to load failure if the film does not have an appropriate tension to maintain the geometry of the items comprising the load or to properly support the load at different heights along the load. For example, a layer of film near the top of bottom of the load may require increased or decreased tension while middle layers may not require the same amount of tension from the film. Furthermore, a relatively heavy weight load may benefit from or require the film be wrapped at a high tension. A relatively light weight load may benefit from or require light film tension. Furthermore, inner layers of film may require less tension in order to prevent film breakage on the load, while outer layers may have more tension in order to properly secure the load. Alternatively, inner layers may require more tension, while outer layers may have less tension to provide better abrasion resistance. The advantages of discretely varying the tension of the film as applied to the load can provide a benefit to wrap a load with film according a particularized wrapping pattern. Thus, a more precise wrapping pattern can be determined and load failure or load damage can be minimized.

Alternatively, in place of a system being commanded to execute a known force and adjusting the film payout speed, a system could be used so that a film payout speed is set and either the force on a biasing system is adjusted to meet a target dancer bar, or similar device's, position. Alternatively the resultant position of the dancer bar or similar device is read and the result is matched to a known force taken either from a database or calculated. Alternatively, a film payout speed may be commanded and the actuator or film tension biasing device may be adjusted to meet the demand.

A system for wrapping a load with a film from a film dispensing carriage comprising of at least one film tensioning roller, a downstream sensor between the film tensioning roller and the load to be wrapped, a preloaded roller between the film tensioning roller and the downstream sensor, a preloading mechanism for biasing the preloaded roller, a sensor to measure the film tensioning roller, and a module within the controller for determining or collecting data based upon a first sensor measurement for the film length or speed on the at least one film tensioning roller and a second sensor measurement for the film length or speed downstream of the preloaded roller.

The measurements of the first, second, and third sensors 140, 142, 170 can determine data representative of the length of the film 30 passing over the first and second non-powered rollers 120, 136 and the force applied to the dancer assembly 122 by the springs 166, which can be utilized to determine the relative stiffness or the tensioned strength of the film 30 being ran through the film dispenser carriage 26 and onto the load 32. The information from the sensors 140, 142, 170 and the force applied to the dancer assembly 122 can be communicated to the controller 50, where the CPU 52 can determine the absolute or relative stiffness of the film 30. A software program stored within the memory 54 of the controller 50 can make this determination, for example.

The number of sensors used to measure dimensional changes and the force on the film may be one or more. There is no limit to the maximum number of sensors that can be utilized.

The stiffness of the film 30 being applied to the load 32 can be further utilized to determine, at least in part, an appropriate pattern for the film 30 to be applied to the load 32 such that effective wrapping of the load 32 is achieved. It should be appreciated that measuring the stiffness of the film is beneficial to properly implementing a wrapping pattern on a load, recommending a wrapping force, or recommending a pre-stretch level for the film. A load can be properly wrapped with an amount of film, however, can still be subject to load failure if the film does not applied with the appropriate tension to maintain the geometry of the items comprising the load. Additionally, as the dancer assembly can vary the tension of the film passing through the film dispenser carriage, it is further beneficial to measure the discrete stiffness of the film as being applied to the load. For example, a layer of film near the top of bottom of the load may require increased or decreased tension while middle layers may not require the same amount of tension from the film. Furthermore, inner layers of film may require less tension in order to prevent film breakage on the load, while outer layers may have more tension in order to properly secure the load. Alternatively, inner layers may require more tension, while outer layers may have less tension to provide better abrasion resistance. These examples are not meant to limit the potential benefit of wrapping with discrete wrapping forces or stretch levels at different points within the wrap pattern. The advantages of measuring the film stiffness as applied to the load can provide a benefit to determine a particular wrapping pattern tailored to a particular load. Thus, a more precise wrapping pattern can be determined and load failure or load damage can be minimized.

This system is designed for stretch wrapping equipment which includes but is not limited to turntable, rotary arm, and horizontal or vertical ring wrappers. The system can determine a wrapping pattern based on known or determined characteristics of the film, particularly stiffness, and executes the wrapping pattern by providing appropriate machine settings such that effective wrapping of the load is achieved.

Aspects of the invention include a method of applying a stretch film wrap to a load with the steps in combination of loading the load into the wrapping area of a film wrapping apparatus, loading a film roll in a film dispenser carriage, receiving in a controller operably coupled with the film dispenser carriage and the turntable, data about the load and prospective transportation of the load, determining a containment force for the load based at least in part on the data about the load and prospective transportation of the load, receiving in the controller, data about the film, determining a containment force per layer for the film based on the data about the film, determining a wrapping pattern for the load based on the containment force and the containment force per layer, attaching an end of the film roll to the load; and, providing relative rotation between the film wrapping equipment and load and moving the film dispenser carriage to apply the film to the load according to the wrapping pattern. The data about the load and prospective transportation of the load and/or data about the film can include at least one of overall weight, stacking pattern, shipping method, trip length, load value, load phase, load dimensions, product rigidity, product or package coefficient of friction, or miscellaneous stability. The data about the load and prospective transportation of the load and/or data about the film can be manually inputted into a data receiver, or it can be determined automatically using one or more sensors on the film wrapping apparatus, or a combination of both. A sensor affixed to the film wrapping apparatus can automatically input the data about the load and prospective transportation of the load and/or data about the film to a data receiver.

Other aspects of the invention include a film wrapping apparatus comprising a turntable, a film dispenser carriage disposed adjacent the turntable; and a controller operably coupled with the turntable and the film dispenser carriage, wherein the controller has a data receiver to receive data about a load and prospective transportation of the load, and a module to determine a wrapping pattern for the load based at least in part on the data about the load and prospective transportation of the load and or data about a film to wrap the load so that the controller can operate the turntable and the film dispenser carriage according to the wrapping pattern. The data about the load and prospective transportation of the load includes at least one of overall weight, stacking pattern, shipping method, trip length, load value, load phase, load dimensions, product rigidity, product or package coefficient of friction, or miscellaneous stability. The data about the film can include at least one of film thickness, width, composition, construction, manufacturing method, stiffness, strength, relative quality or performance, puncture resistance, cling, or other properties. The data about the load and prospective transportation of the load and/or data about the film can be manually inputted into a data receiver before or during application of the film, or it can be determined automatically before during or after the film is applied, or automatically read into the data receiver, or any combination thereof. A sensor affixed to the film wrapping apparatus can automatically input the data about the load and prospective transportation of the load and/or data about the film to a data receiver. At least one sensor can comprise a weight sensor or a laser sensor or both.

Further aspects of the invention include a film wrapping apparatus for wrapping film around a load comprising, a film dispenser carriage having at least one film tensioning roller disposed within the film dispenser carriage, a first roller, downstream of the film tensioning roller, a second roller, downstream of the first roller, a force-related device disposed between the two non-powered rollers, a first sensor to take a measurement of the film passing over the first non-powered roller; and a second sensor to take a measurement of the film passing over the second non-powered roller. A controller is operably coupled to the first and second sensors to receive the measurements, and a module in the controller is configured to determine data about the film based upon the length measurements and force and determine a wrapping pattern based at least in part on the data. The film tensioning roller can be contained as part of a prestretch section. More than two non-powered rollers can be utilized within the film dispenser carriage. The force-related device can be a dancer assembly which includes a dancer bar pivotably connected to a shaft being fixed to the carriage assembly and a dancer roller rotatably mounted to the dancer bar. The dancer assembly can be coupled to a spring to apply tension to the film. The dancer assembly can pivot relative to the fixed point of the shaft on the carriage assembly. The pivot range can be 0 to 180 degrees. At least one position sensor can be operably coupled to the rotatable dancer bar and at least one force sensor can be on the spring. The first and second sensors can be counters, length or speed measurement, or force sensors.

Further aspects of the invention include a film wrapping apparatus for wrapping film around a load comprising, a film dispenser carriage having at least one film tensioning roller disposed within the film dispenser carriage, a first roller, downstream of the film tensioning roller, a second roller, downstream of the first roller, a force-related device disposed between the two non-powered rollers, a first sensor to take a measurement of the film passing over the first non-powered roller; and a second sensor to take a measurement of the film passing over the second non-powered roller. A controller is operably coupled to the first and second sensors to receive the measurements, and a module in the controller is configured to determine data about the film based upon the length measurements and force and determine a wrapping pattern based at least in part on the data. The film tensioning roller can be contained as part of a prestretch section. More than two non-powered rollers can be utilized within the film dispenser carriage. The force-related device can be a load cell or pressure sensor.

Further aspects of the invention include a film wrapping apparatus for wrapping a film around a load comprising a film dispenser having a drive mechanism providing relative rotation between the film wrapping apparatus and the load, at least one film dispensing carriage, a spindle for carrying a roll of stretchable film, at least one film tensioning roller disposed within a film dispenser carriage, at least one non-powered roller downstream of the film tensioning roller; and at least one force-related device downstream of the non-powered roller for determining the force between the non-powered roller and the load. A first sensor can take a measurement of the film passing over the non-powered roller and a second sensor can count the number of film revolutions applied during the relative rotation of the load. The dimensions of the unit load being wrapped are determined and a controller is operably coupled to the first and second sensors to receive the film and revolution measurements, and is operably coupled to the force-related device. A module in the controller is configured to determine data about the film based upon the film, revolution, force, and load dimensions and determine a wrapping pattern based at least in part on the data. The film tensioning roller can be contained as part of a prestretch section. More than two non-powered rollers can be utilized within the film dispenser carriage. The force-related device can be a dancer assembly which includes a dancer bar pivotably connected to a shaft being fixed to the carriage assembly and a dancer roller rotatably mounted to the dancer bar. The dancer assembly can be coupled to a spring to apply tension to the film. The dancer assembly can pivot relative to the fixed point of the shaft on the carriage assembly. The pivot range can be 0 to 180 degrees. At least one position sensor can be operably coupled to the rotatable dancer bar and at least one force sensor can be on the spring. The first and second sensors can be counters or force sensors. The force-related device can be a pressure sensor. The first sensor can be a counter on the non-powered roller. The second sensor can be a counter on a turntable or a counter on a rotatable arm. The dimensions of the load being wrapped can be input by the user or stored in a database. The dimensions of the load being wrapped can be measured by a sensor. The dimensions of the load being wrapped can be the length and width of the unit load. The length and width dimensions can be used in conjunction with the second sensor to determine a total length of film applied to the unit load being wrapped.

Further aspects of the invention include a system for wrapping a load with a film from a film dispenser carriage comprising a first non-powered roller, a second non-powered roller, a spring-tensioned roller coupled to a spring and disposed between the first and second non-powered rollers, and an actuator for biasing the spring. A first sensor is provided to measure the first non-powered roller, and a second sensor is provided to measure the second non-powered roller. A controller can be operably coupled with the actuator to receive position or force input, controller may alternatively receive actuator information by manual input. Controller is communicatively coupled with the first and second sensors; and a module is within the controller for determining data based upon the first and second sensor measurements. The measurements of the first and second sensors are used to determine a length of film passing over the first and second non-powered rollers and a force being experienced between the first and second non-powered rollers, such that the module can determine data representative of the relative stiffness of the film being fed through the film dispenser carriage. At least one pre-stretch roller can be not powered. The spring-tensioned roller can include a bar pivotably connected to a shaft being fixed to the carriage assembly enabling the bar to pivot about the fixed shaft. A force effected by the spring can pivot the spring-tensioned roller about the fixed shaft. The first and second sensors can be a calibrated counter on the first and second non-powered rollers. A third sensor can be on the spring, and it can be a pressure transducer. Multiple prestretch rollers can be adjacent to one another.

Further aspects of the invention include a system for monitoring and controlling application of a film to a load comprising a film holder to payout stretchable film from a roll, at least one film tensioning roller to cause the stretchable film between the film holder and the load to stretch; a dancer bar carrying a dancer roller pivotably mounted so that the dancer roller pivots relative to the at least one guide roller, a spring coupled to the dancer bar to bias pivotable movement of the dancer roller, a sensor disposed to monitor the position of the dancer bar and to send data signals representative of the position of the dancer bar, an actuator coupled to the spring to adjust the position of the spring, and a controller communicatively coupled to the sensor and operably coupled to the actuator to determine the position of the dancer bar based on the data signals, and to cause either the actuator to adjust the position of spring and the position of the dancer bar, or adjust a payout speed of the stretchable film to the load or a combination to adjust film tension. The sensor can be a pressure sensor or a pressure transducer on the spring. The dancer roller can be non-powered. The dancer bar can be pivotably connected to a shaft of a roller fixed to a carriage assembly. Pivoting movement of the dancer bar can be relative to the shaft. Pivoting movement of the dancer increases or decreases tension of the stretch film downstream of the film tensioning roller. At least one non-powered roller can be downstream of the film tensioning roller. The system can include a second sensor for measuring at least one non-powered roller. The second sensor can be calibrated counter on the non-powered roller.

Further aspects of the invention include a system for monitoring and controlling the application force of a stretch film comprising at least one film tensioning roller to stretch film before or while applying the film to a load, a non-powered roller to guide the, and a dancer bar carrying a dancer roller disposed between the at least one film tensioning roller and the non-powered roller and pivotably mounted so that the dancer roller pivots relative to the at least one film tensioning roller to apply to tension to the film. A spring can be coupled to the dancer bar to bias pivotal movement of the dancer bar toward or away from the at least one film tensioning roller. An actuator can be coupled to the spring to effect the bias of the spring on the dancer bar. A sensor can be disposed to measure the position of the dancer bar, and a controller is operably coupled to the actuator and communicatively coupled to the sensor to determine the position of the dancer bar. The controller can actuate the actuator coupled to the spring to increase or decrease the bias of the spring on the dancer bar to increase or decrease the tension on the film as it is wrapped onto the load. The dancer roller can be non-powered. The sensor can be a pressure sensor. The dancer bar can be pivotably connected to a shaft of a guide roller fixed to a carriage assembly. Pivoting movement of the dancer bar can be relative to the shaft. The pivoting movement of the dancer bar increases or decreases tension of the stretch film downstream of the at least one film tensioning roller. Increasing or decreasing the tension can further comprise increasing or decreasing the rate at which the stretch film is paid out from the at least one film tensioning roller. The pivotal movement of the dancer bar forward or rearward increases or decreases the tension on the film and can be coupled with a controller to adjust the payout speed from the at least one film tensioning roller. The increased or decreased payout speed increases or decreases the tension of the stretch film.

This written description uses examples to disclose the invention, including the best mode, and to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of applying a stretch film wrap to a load comprising:

loading the load on a load support of a film wrapping apparatus;

loading a film roll having a discrete stiffness in a film dispenser carriage;

receiving in a controller operably coupled with the film dispenser carriage and the load support, data representing the discrete stiffness of the film;

determining a wrapping pattern for the load based at least in part on data representing the discrete stiffness of the film;

moving one of the load support or the film dispenser carriage relative to the other to apply the film to the load according to the wrapping pattern; and measuring the film while moving one of the load support or the film dispenser carriage relative to the other to generate the data representing the discrete stiffness of the film.

2. The method of claim 1 wherein the measuring includes measuring at least one of measuring roller rotation, rate of rotation of a roller, length of the film passing over a portion of a roller, or measuring speed of roller surfaces or film speed located at a sensor position.

3. The method of claim 1 wherein the measuring occurs before determining the wrapping pattern.

4. The method of claim 1 wherein the data representing the discrete stiffness of the film is stored in a memory.

5. The method of claim 1 further comprising inputting the data representing the discrete stiffness of the film into a user interface coupled to the controller.

6. The method of claim 1 wherein the data representing the discrete stiffness of the film is stored in a memory coupled to the controller.

7. A system for applying a stretch film wrap to a load comprising: a load support;

a film dispenser carriage disposed adjacent the load support having film with a discrete stiffness to wrap a load on the load support;

first and second non-powered rollers to feed the film to the load;

a sensor on each of the first and second non-powered rollers for measuring the film to generate data representing the discrete stiffness of the film; and a controller operably coupled with the load support and the film dispenser carriage; wherein the controller is configured to receive the data representing the discrete stiffness of the film generated by measuring the film while moving one of the load support or the film dispenser carriage relative to the other to generate the data representing the discrete stiffness of the film, and is further configured to determine a wrap pattern for the load based at least in part on the data representing the discrete stiffness, so that the controller can operate at least one of the load support or the film dispenser carriage according to the wrapping pattern to wrap the load.

8. The system of claim 7 further comprising: at least one film tensioning roller to stretch film before applying the film to the load; the sensor on each of the first and second non-powered rollers to measure the rate of passing film; and a dancer bar between the first and second non-powered rollers, biased for movement toward or away from a position of the at least one film tensioning roller; wherein force on the dancer bar is known based on the position and the data representing the discrete stiffness includes the dancer bar force.

9. The system of claim 7 further comprising: at least one film tensioning roller to stretch film before applying the film to a load; the sensor on each of the first and second non-powered rollers to measure the rate of passing film; and a load cell between the first and second non-powered rollers to measure force on the film as it passes between the first and second non-powered rollers; wherein the data representing the discrete stiffness includes the force measured by the load cell.

10. The system of claim 7 further comprising at least one sensor configured to measure one of stretch, length/speed change, force, tension on the film, wrapping force, or tension on the load to generate the data representing the discrete stiffness of the film.

11. The system of claim 7 further comprising a user interface coupled to the controller wherein the data representing the discrete stiffness of the film can be inputted.

12. The system of claim 7 further comprising a memory coupled to the controller where the data representing the discrete stiffness of the film is stored.

13. A method of applying a stretch film wrap to a load comprising:

loading the load on a load support of a film wrapping apparatus;

loading a film roll in a film dispenser carriage;

receiving in a controller operably coupled with the film dispenser carriage and the load support, data about the load, data representing the discrete stiffness of the film, and data about prospective transportation of the load;

determining in the controller an overall recommended containment force for the load based on data about the load, data representing the discrete stiffness of the film, and data about prospective transportation of the load;

determining in the controller a containment force per layer for the film based on the data about the load and the data about prospective transportation of the load;

determining a wrapping pattern for the load based on the overall recommended containment force and the containment force per layer, and a width of the film;

moving at least one of the load support or the film dispenser carriage relative to the other to apply the film to the load according to the wrapping pattern; and measuring the film while moving one of the load support or the film dispenser carriage relative to the other to generate the data representing the discrete stiffness of the film.

14. The method of claim 13 wherein the measuring includes measuring at least one of stretch, length/speed change, force, tension on the film, wrapping force, or tension on the load to generate the data representing the discrete stiffness of the film.

15. The method of claim 13 wherein the measuring occurs before determining the wrapping pattern.

16. The method of claim 13 further comprising manually inputting the data representing the discrete stiffness of the film into a user interface connected to the controller.

17. The method of claim 13 wherein the data representing the discrete stiffness of the film is stored in a memory coupled to the controller.

* * * * *